US011686087B2

(12) United States Patent
Fabis

(10) Patent No.: US 11,686,087 B2
(45) Date of Patent: Jun. 27, 2023

(54) RIGID FOAM BOARD INSTALLATION CLIP

(71) Applicant: Paul Fabis, Westmoreland, NH (US)

(72) Inventor: Paul Fabis, Westmoreland, NH (US)

( * ) Notice: Subject to any disclaimer, the term of this patent is extended or adjusted under 35 U.S.C. 154(b) by 0 days.

(21) Appl. No.: 17/406,177

(22) Filed: Aug. 19, 2021

(65) Prior Publication Data

US 2022/0090373 A1 Mar. 24, 2022

Related U.S. Application Data

(60) Provisional application No. 63/081,035, filed on Sep. 21, 2020.

(51) Int. Cl.

| | |
|---|---|
| ***E04B 1/38*** | (2006.01) |
| ***E04B 1/76*** | (2006.01) |
| ***E04B 1/41*** | (2006.01) |

(52) U.S. Cl.

CPC ..... *E04B 1/40* (2013.01); *E04B 1/7654* (2013.01)

(58) Field of Classification Search

CPC .... E04B 1/40; E04B 1/7654; E04B 2001/405; E04B 1/6112; F16B 2/12; F16B 2/14

USPC ..... 52/506.06

See application file for complete search history.

(56) References Cited

U.S. PATENT DOCUMENTS

| | | | | |
|---|---|---|---|---|
| 3,218,771 | A | 11/1965 | Horn | |
| 3,359,697 | A | 12/1967 | Smith et al. | |
| 4,257,204 | A | 3/1981 | Rieger | |
| 4,287,839 | A | 9/1981 | Severin et al. | |
| 4,495,741 | A | 1/1985 | Pasiecznik | |
| 8,955,280 | B2 | 2/2015 | Fabis | |
| D747,953 | S * | 1/2016 | Thompson | D8/349 |
| 9,243,400 | B2 | 1/2016 | Fabis | |
| 9,458,625 | B2 | 10/2016 | Fabis | |
| D786,053 | S * | 5/2017 | Fabis | D8/380 |
| 9,945,403 | B2 | 4/2018 | Fabis | |
| 10,221,872 | B2 | 3/2019 | Fabis | |
| D962,755 | S * | 9/2022 | Fabis | D8/380 |
| 2005/0217196 | A1 | 10/2005 | Fogg | |
| 2009/0056255 | A1 | 3/2009 | Barton | |
| 2014/0245683 | A1* | 9/2014 | Fabis | E04C 2/10 52/309.4 |
| 2016/0369943 | A1* | 12/2016 | Fabis | E04B 9/366 |

* cited by examiner

*Primary Examiner* — Brian E Glessner
*Assistant Examiner* — James J Buckle, Jr.
(74) *Attorney, Agent, or Firm* — Lambert Shortell & Connaughton; David J. Connaughton, Jr.; Justin P. Tinger

(57) ABSTRACT

A clip for facilitating installation of foam insulation boards in a building structure. The clip comprises a body, a spacer and plurality of prongs extending from the body for holding the insulation board, and a connection region for attachment of the clip to a building structural member. The clip is designed to ensure proper ventilation and greatly ease the proper installation of rigid foam insulation.

19 Claims, 5 Drawing Sheets

RIGID FOAM BOARD INSTALLATION CLIP

BACKGROUND OF THE INVENTION

Field of the Invention

The present invention relates generally structural connectors. More particularly, the present invention relates to a clip for attaching rigid foam insulation to a building's structural members.

Description of Related Art

The need for properly installed and correctly located insulation is not easily met using current construction practices. Rigid foam insulation board (sometimes referred to as RFB) is, in present common practice, supported by strips of lath (nailers) nailed to the rafters, joists, or beams between which the insulation board is to be installed. Supporting the insulation board while attaching the nailers is difficult, especially if the spacing between the rafters, joists, or beams is insufficient to swing a hammer. Further, precise placement of the nailer is difficult. As such, current practices utilize excess material and require extensive labor in the milling and installing processes to properly install the rigid foam insulation board. This difficulty can in some cases lead to injury because of the difficult maneuvers being performed on ladders and in off-balance positions. Further, precise workmanship of the task is very time consuming and costly. The current products available for providing roof ventilation do not provide a fully vented space. This lack of venting restricts air flow, and promotes moisture entrapment which results in potential ice damming, poor indoor air quality and early deterioration of roof sheathing and roofing.

Therefore, what is needed is a more efficient structure and method of installing rigid foam insulation board.

SUMMARY OF THE INVENTION

The subject matter of this application may involve, in some cases, interrelated products, alternative solutions to a particular problem, and/or a plurality of different uses of a single system or article.

In one aspect, a rigid foam insulation board installation clip is provided. The clip comprises a body having a spacer at its distal end, and a connection region at its proximal end. The spacer has a top and a bottom, and has at least a portion of the bottom extending approximately perpendicularly from a front face of the body in a same direction that the spacer extends away from the body. The clip further comprises a plurality of prongs along the body at a distance away from the spacer. These prongs are flexible and can flex as a foam board is urged against them towards the spacer. In some embodiments, the prongs may by approximately cylindrical and may extend from the body. In other embodiments, the prongs may have a square or rectangular cross section. In still further embodiments, the individual prongs may extend from one side of the body to the other widthwise. Accordingly, the prongs may be any structure which can extend away from the body without straying from the scope of this invention. When the foam is properly positioned, the spacer and at least one prong define a cavity between them in which the foam is held. This cavity is defined at a top and bottom by the spacer and at least one prong, respectively, having an open front and sides, and a rear defined by the body.

DETAILED DESCRIPTION

Figure 1:
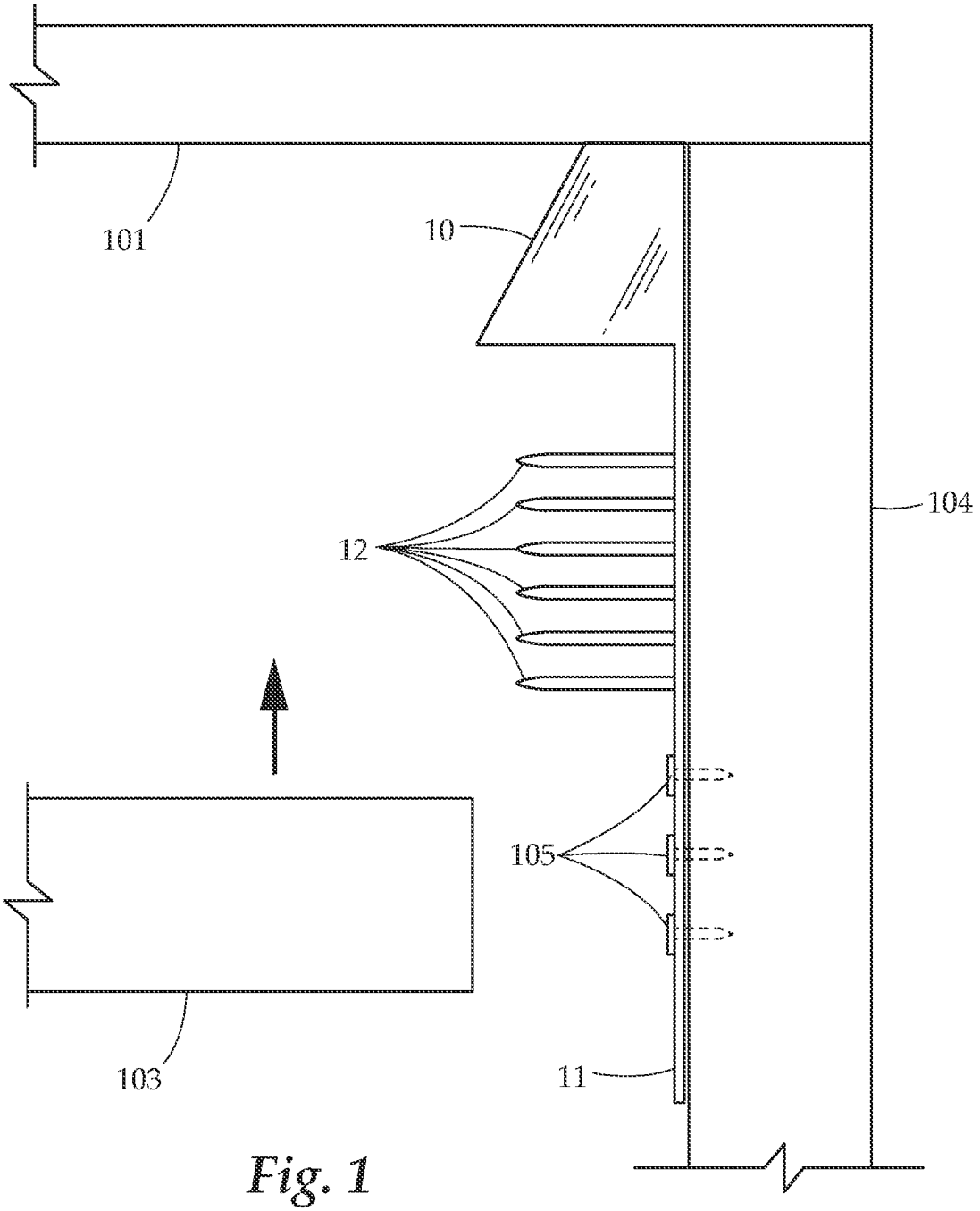
FIG. 1 provides a side view of an embodiment of the installation clip in an installed position.
Figure 2:
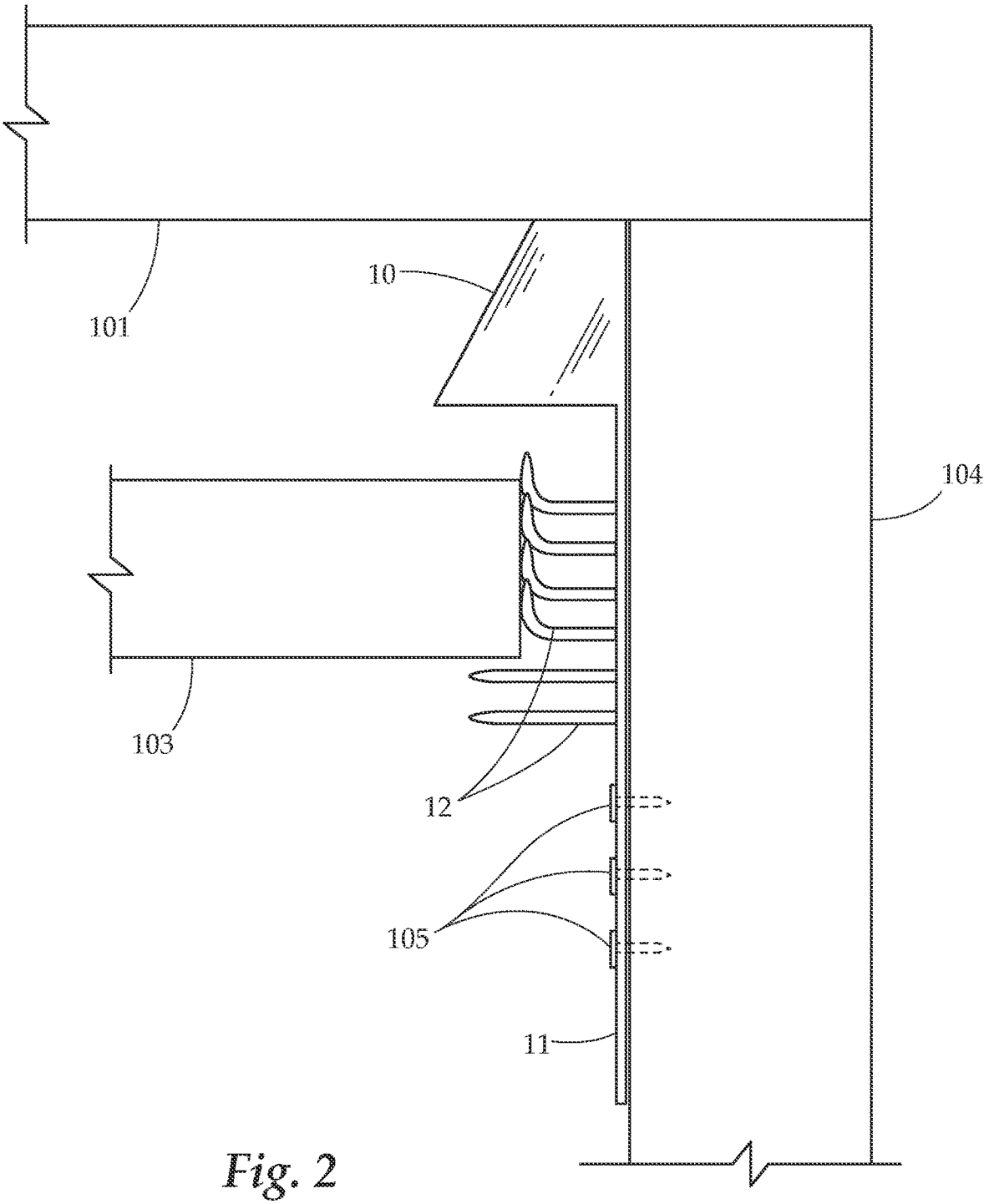
FIG. 2 provides a side view of an embodiment of the installation clip in use.
Figure 3:
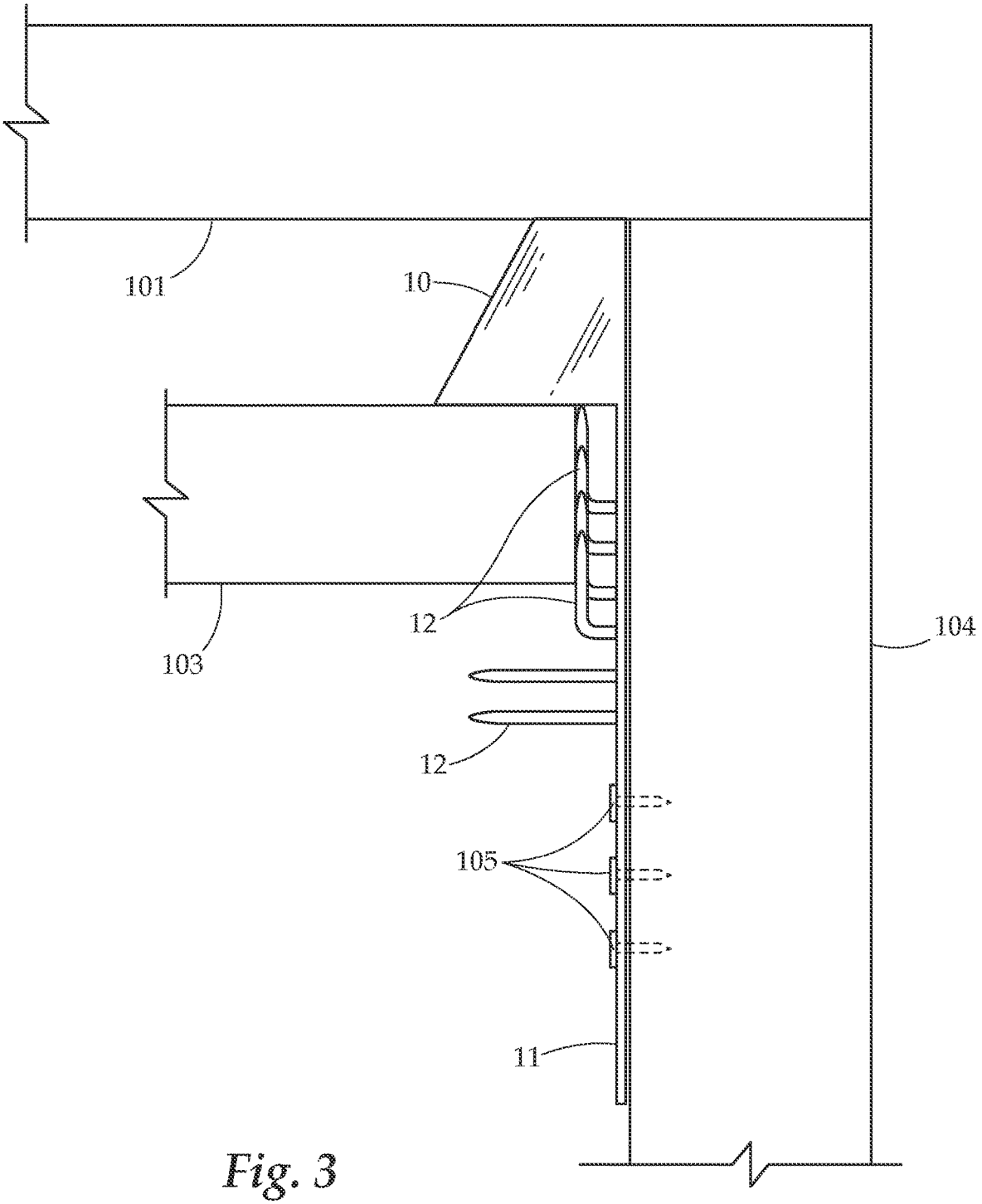
FIG. 3 provides a side view of another embodiment of the installation clip in use.
Figure 4:
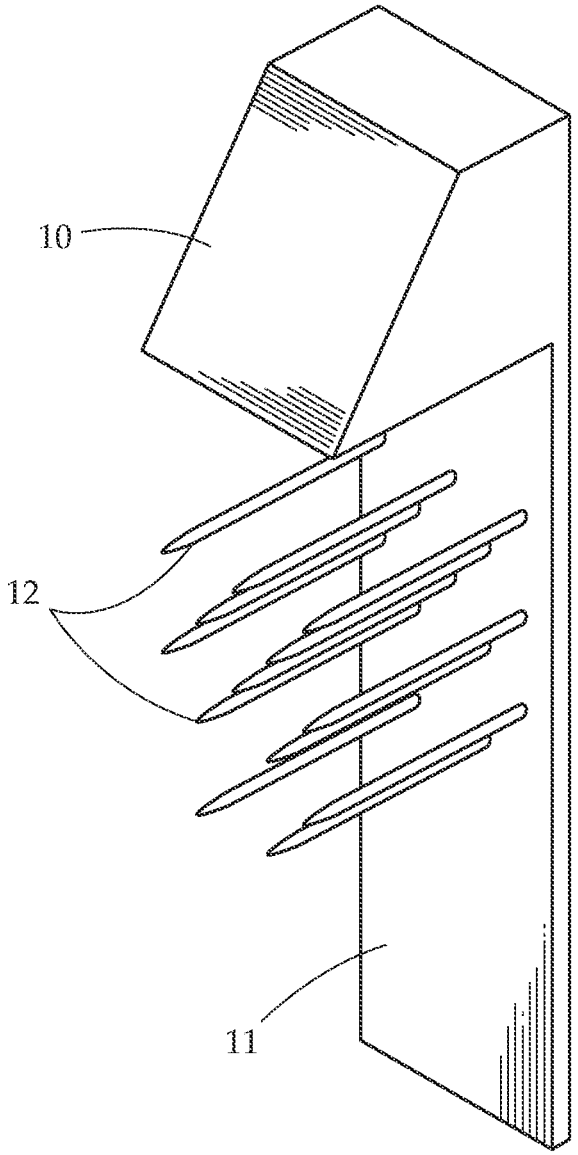
FIG. 4 provides a side view of an yet another embodiment of the installation clip.
Figure 5:
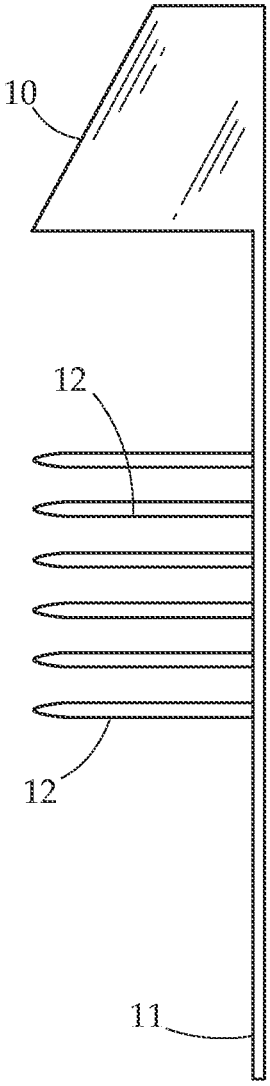
FIG. 5 provides a perspective view of still another embodiment of the installation clip.
Figure 6:
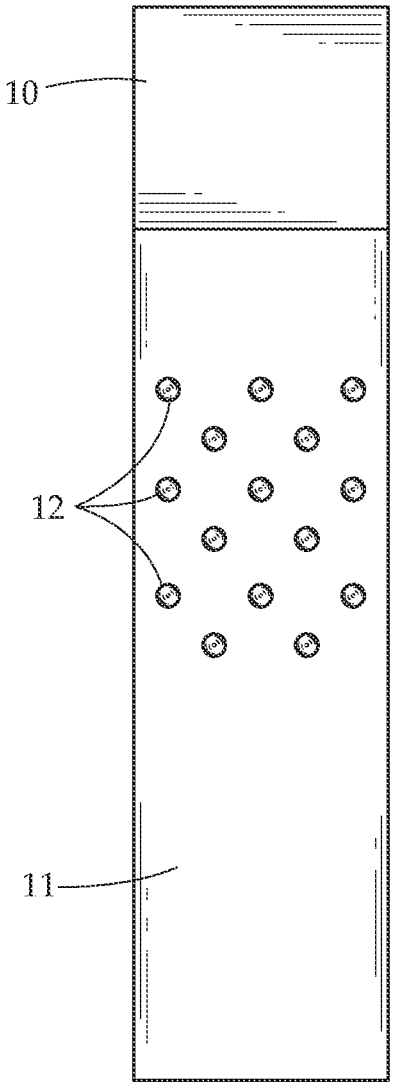
FIG. 6 provides a front view of another embodiment of the installation clip.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a clip that may be attached to rigid foam board insulation for building insulation, the clip is also configured to be attachable to building structural members. As such, the installation of rigid foam insulation is greatly facilitated. The present clip invention may be used in any condition where rigid foam insulation is being installed. For example, the clip may be used in new construction, existing buildings, renovations, and the like.

The clip consists of a spacer configured to provide an air spacing between a sheathing or flooring and the insulation when installed. A body of the clip may extend downwards away from the spacer. This body is designed to be attached to a building framing or other structural member, such that a rear face of the body may abut the structural member. This allows the foam insulation board to which the clip is attached to be secured in place, and properly spaced from the sheathing. The clip further comprises a series of prongs which extend away from the body of the clip. These prongs extend away from a front face of the body and are flexible. This flexibility allows the foam to be urged upward against the prong towards the spacer. As the foam passes over the prongs, the pressure from the flexed prongs allows the foam to be held in place and resists the foam moving back in the opposite direction.

The installation clip contemplated herein is configured to accept multiple differently sized foam insulations. For example, the most commonly sized insulations have thicknesses of ½ inch, 1 inch, and 1½ inch. The installation clip may be any size capable of connecting to and supporting the foam insulation board. Size may vary depending on application, and it should be understood that the sizing of the clip is in no way limited based on the disclosure herein.

The installation clip contemplated herein may be formed of any material rigid enough to connect to and support the foam insulation board, and resilient enough to be attached to the building structural members. For example, materials of which the installation clip may be made include, but are not limited to, plastics, wood, metals, composite materials, ceramics, combinations thereof, and the like.

The clip may be attached to the building structural members (rafters, joists, beams, etc.) in any manner capable of supporting the insulation. For example, the clip may be mechanically connected to the structural members by fasteners such as nails, staples, screws, tacks, and the like. In other embodiments, adhesives, pressure connections, and the like may be employed. In many cases, gaps are created between the foam insulation boards and the rafters, joists, beams, or the like, to which the insulation boards have been attached. These gaps may be sealed in any manner. In one embodiment, the gaps may be sealed with beads of foam sprayed to bridge these gaps. Framing with irregular centers, or those centers out of parallel may require individual measuring and cutting of the insulation board to fit each location. However, even in such cases, the clips described herein may still be utilized, and the clips may be positioned specifically based on the configuration of the irregular space.

Turning now to FIGS. 1-6, an embodiment of the installation clip in use is shown. A spacer 10 is shown here as a trapezoid, having a front face sloping inwards from the bottom to the top, the bottom of the spacer extending further from the body than the top. However, the spacer could be of any shape without straying from the scope of the present invention. Generally, it can be seen that the clip has a body which includes the connection region 11. The spacer 10 extends from a distal end of the body and has a top and bottom. The top of the spacer 10 is at a terminal end of the distal end of the clip, and the bottom and top of the spacer 10 are each oriented approximately perpendicular to the body so that they have approximately parallel faces. The connection region 11 on a part of the body which is on an opposite side from the bottommost of the prongs from the spacer. A plurality of prongs 12 extend from the body. In this embodiment, the prongs 12 are fixedly connected to the body. The prongs 12 are positioned along the body at a distance from the spacer 10. In use, the foam 103 is urged upwards against the prongs 12, causing them to bend toward the spacer 10. Depending on the thickness of the foam 103, one or more prongs 12 may remain bent and applying force against the foam 103 when the foam top is abutting the bottom of the spacer 10. As such, a cavity is defined by the clip such that the spacer 10 and at least one prong 12 define a cavity between them in which the foam is held. It should be noted that in some embodiments, the bottom of the cavity may be defined by the topmost prong 12, while in other embodiments, the bottom of the cavity may be defined by another prong 12, having prongs 12 above it which are bent and engaged with the foam 103. Therefore, the cavity is defined at a top and bottom by the spacer 10 and at least one prong, respectively, having an open front and sides, and a rear defined by the body.

A front face of the body defines a rear of the cavity which is open on its front and sides. In the embodiment shown, the prongs and spacer protrude laterally away from the body to approximately the same distance. As seen in FIG. 1, the connection region of 11 of the body is held to the building structure via, in this embodiment, a nail or nails 105.

When thoroughly installed, the spacer ensures that there is a uniform depth of air space between the insulation board and sheathing. Prongs extend from the front face of the body and flex to engage with the foam insulation board as it is urged upward towards the spacer. The flexing and force applied to the foam holds it in place, and also prevents the foam from passing back over the prongs. In some embodiments the prongs may slightly sink into the foam face, thereby "hooking" into it, and further preventing rearward motion of the foam. Positioning of the prongs may vary in some embodiments depending on what size foam insulation is intended to be used. In other embodiments, the clip may be universal and may work for a wide variety of foam thicknesses.

The body of the clip is connected to a building structural member 104 by fasteners (screws, staples, pins, tacks, nails, adhesives, and the like). A foam insulation board 103 is in turn connected to the structural member 104 via the clip. When installed, the foam insulation board 103 will be secured between the spacer 10 and one or more prongs 12, such that it is effectively spaced apart from the upper substrate 101. On an opposite side of the foam, a similar clip is connected to an opposing structural member to hold the opposite end of the foam in place as well. Of course, many clips may be used along the length and/or width of the foam as is needed and depending on the size of the foam insulation board 103 being installed. As shown best in FIG. 3, when properly placed, the foam 103 abuts spacer 10 bottom, and a plurality of the prongs are bent upward which apply a force into the surface of the foam 103, thereby holding it in place. The somewhat soft nature of the foam insulation 103 allows the prongs 12, in some embodiments, to sink slightly into a surface of the foam, further ensuring that the foam is held or even "hooked" securely into place. Any forces drawing the foam downward against the upwardly bent prongs will urge the prongs deeper into the foam, making it harder for the foam to be removed. Accordingly, this configuration and structure of the clip provides for an easy installation, and very secure holding of the foam in place once positioned. The spacer 10 abuts a substrate such as, for example, sheathing (of sub-flooring, roofing, or the like) 101 at its top, abuts the foam insulation board 103 at its bottom, and is sized to provide an air space 102 between the insulation board 103 and sheathing 101 (or other building structural component as discussed herein). When thoroughly installed, the spacer 10 ensures that there is a uniform depth of air space between the insulation board 103 and sheathing 101.

The body of the clip forms an elongate strip that extends downward from where the spacer secures the insulation board. This extending strip is configured as a connection region to be attached to the building structural members to thereby secure the clip and insulation in place.

As shown, the prongs are positioned along the body at a distance away from the spacer such that at least one of the prongs and the bottom of the spacer define a cavity between them, the cavity having an open front and sides, and a rear defined by the body.

In further embodiments, the present invention may enhance the operation of radiant floor heating. The use of the installation clips described herein will result in uniform distance of air space between the insulation board and the surface beneath which it is suspended. The clips can be used horizontally beneath sub-floor and radiant tubing to attach the insulation boards between floor joists. This uniform distance of air space may provide for consistence spacing of radiant heating components beneath a sub-flooring and may achieve a more uniform floor temperature during the heating season.

Moreover, in some embodiments, the present invention may enhance roof ventilation and insulation. The current standard method for roof ventilation is attached to the roof deck itself and does not allow a fully ventilated cavity, which may introduce ice damming among other problems. This standard method has no structural integrity and will only allow a loose fill insulation be used to fill the remainder of the cavity as opposed to the foam board insulations with clips taught herein which allows for a dense pack insulation to be used. Thus the present invention just allows for a maximized insulating value without the danger of ice damming. Although there are many roof ventilation methods, there are none that provide the ventilation as described in the use of the clips taught herein. Specifically, the use of the installation clips provide ventilation vertically at heels of rafters or roof trusses. Further they allow adequate air sealing and blocking for the remainder of the cavity to be filled with dense pack cellulose or another type of insulation to provide a desired insulation value. Further still, in some embodiments, the clips may be used beneath a roof deck. Further, the vertical installation of the clips and panels when installed at the heels of roof rafters and trusses are important to conforming to the national energy code for insulating over exterior wall plates.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth. Further, while the clip is described herein as being configured for a foam insulation board, it should be understood that the clip may be used to hold any board or similar elongate element.

What is claimed is:

1. A foam insulation board installation clip comprising:

a body, the body having a connection region, the body being mountable to a building structural member;

a spacer extending from a distal end of the body, the spacer having a top and a bottom, and a spacing height between the top and the bottom, the top of the spacer being a terminal end of the distal end of the clip, wherein the bottom is oriented approximately perpendicular to the body, and is spaced apart from the top, wherein the top is approximately perpendicular to a rear face of the body, such that the top and the bottom are approximately parallel;

a plurality of prongs extending from the body, the plurality of prongs positioned along the body at a distance away from the spacer such that one of the plurality of prongs, a front face of the body, and the bottom of the spacer define a cavity, the cavity having an open front and sides, a rear of the cavity defined by the front face of the body, wherein the plurality of prongs comprises a plurality of prongs in a widthwise direction of the body, and a plurality of prongs in a lengthwise direction of the body; and wherein the plurality of prongs are each flexible and are able to flex as a foam board is urged against each of the plurality of prongs.

2. The foam insulation board installation clip of claim 1 wherein each of the plurality of prongs protrudes laterally away from the front face of the body.

3. The foam insulation board installation clip of claim 1 wherein the spacer protrudes laterally away from the front face of the body.

4. The foam insulation board installation clip of claim 2 wherein the spacer protrudes laterally away from the front face of the body to a distance away from the body that is approximately equal to a distance that at least one of the plurality of prongs protrudes away from the body.

5. The foam insulation board installation clip of claim 1 wherein each of the plurality of prongs is fixedly connected to the body.

6. The foam insulation board installation clip of claim 1 wherein the connection region is positioned on a part of the body that is on an opposite side of a bottommost of the plurality of prongs from the spacer.

7. A foam insulation assembly comprising:

a foam insulation board;

a building structural member, the foam insulation board being connected to the building structural member by a clip, the clip comprising:

a body, the body having a connection region;

a spacer extending from a distal end of the body, the spacer having a top and a bottom, the bottom spaced apart from the top, the top of the spacer being a terminal end of the distal end of the clip, wherein the bottom is oriented approximately perpendicular to the body, and is spaced apart from the top, wherein the top is approximately perpendicular to a rear face of the body, such that the top and the bottom are approximately parallel;

a plurality of prongs extending from the body, the plurality of prongs positioned along the body at a distance away from the spacer such that a top of one of the plurality of prongs, a front face of the body, and the bottom of the spacer define a cavity, the cavity having an open front and sides, a rear of the cavity defined by the front face of the body;

the foam insulation board being positioned within the cavity between the foot the one of the plurality of prongs;

the connection region being attached to the building structural member; and the top of the spacer abutting a substrate, the spacer forming a gap between the substrate and the foam insulation board; and wherein at least one of the plurality of prongs is in an upwardly bent position and in contact with an edge of the foam insulation board.

8. The foam insulation assembly of claim 7 wherein a fastener connects the connection region to the building structural member, the fastener passing through the connection region of the body and into the structural member.

9. The foam insulation assembly of claim 7 wherein the gap defines an air space.

10. The foam insulation assembly of claim 7 wherein the plurality of prongs are each fixedly connected to the body.

11. The foam insulation assembly of claim 7 wherein the structural member is one of a rafter, a joist, and a beam.

12. The foam insulation assembly of claim 7 wherein the plurality of prongs protrude laterally away from the front face of the body.

13. The foam insulation assembly of claim 7 wherein the spacer protrudes laterally away from the front face of the body.

14. The foam insulation assembly of claim 12 wherein the spacer protrudes laterally away from the front face of the body to a distance away from the body that is approximately equal to a distance that the plurality of prongs protrude away from the body.

15. The foam insulation assembly of claim 7 wherein the connection region is positioned on a part of the body that is on an opposite side of a bottommost of the plurality of prongs from the spacer.

16. The foam insulation assembly of claim 7 wherein the connection region is an elongate extension which extends in a direction away from both the spacer and the plurality of prongs.

17. A structure comprising the foam insulation assembly of claim 7.

18. The structure of claim 17 wherein the wherein the plurality of prongs of the clip are fixedly connected to the body of the clip.

19. The structure of claim 17 wherein the connection region is positioned on a part of the body that is on an opposite side of the plurality of prongs from the spacer.

* * * * *